United States Patent [19]

Pascoe et al.

[11] Patent Number: 4,676,296

[45] Date of Patent: Jun. 30, 1987

[54] APPARATUS FOR CASTING METAL ALLOYS HAVING LOW MELTING POINTS

[75] Inventors: Graham Pascoe, Leatherhead, England; Frank Todd, Motherwell; Thomas F. Kidd, Longforgan, both of Scotland

[73] Assignee: Fry's Metals Limited, London, England

[21] Appl. No.: 783,107

[22] Filed: Oct. 2, 1985

[30] Foreign Application Priority Data

Oct. 5, 1984 [GB] United Kingdom ..... 8425182

[51] Int. Cl.[4] ..... B22D 17/00; B22D 17/04

[52] U.S. Cl. ..... 164/303; 164/316; 164/133; 222/594

[58] Field of Search ..... 164/133, 113, 312, 314, 164/316–318, 303; 222/547, 594

[56] References Cited

U.S. PATENT DOCUMENTS 2,831,214 4/1958 Eyles et al. ..... 164/314

3,883,045 5/1975 Gerbig ..... 222/594

FOREIGN PATENT DOCUMENTS 754669 10/1942 Fed. Rep. of Germany ..... 164/314

1151357 7/1963 Fed. Rep. of Germany ..... 164/314

OTHER PUBLICATIONS

Metals Handbook 8th Edition, vol. 5, pp. 285, 286, 306 and 321–323, 1970.

*Primary Examiner*—Nicholas P. Godici

*Assistant Examiner*—Samuel M. Heinrich

*Attorney, Agent, or Firm*—Watson, Cole, Grindle & Watson

[57] ABSTRACT

A casting is made from a low melting point alloy having a solidus temperature in the range of 35°–300° C. by subjecting a charge of molten alloy to pre-pressurization then delivering the charge at a flow rate of 0.1 to 1 kg/sec into a die and maintaining the metal in the die under pressure for a time in excess of that required to fill the die.

6 Claims, 1 Drawing Figure

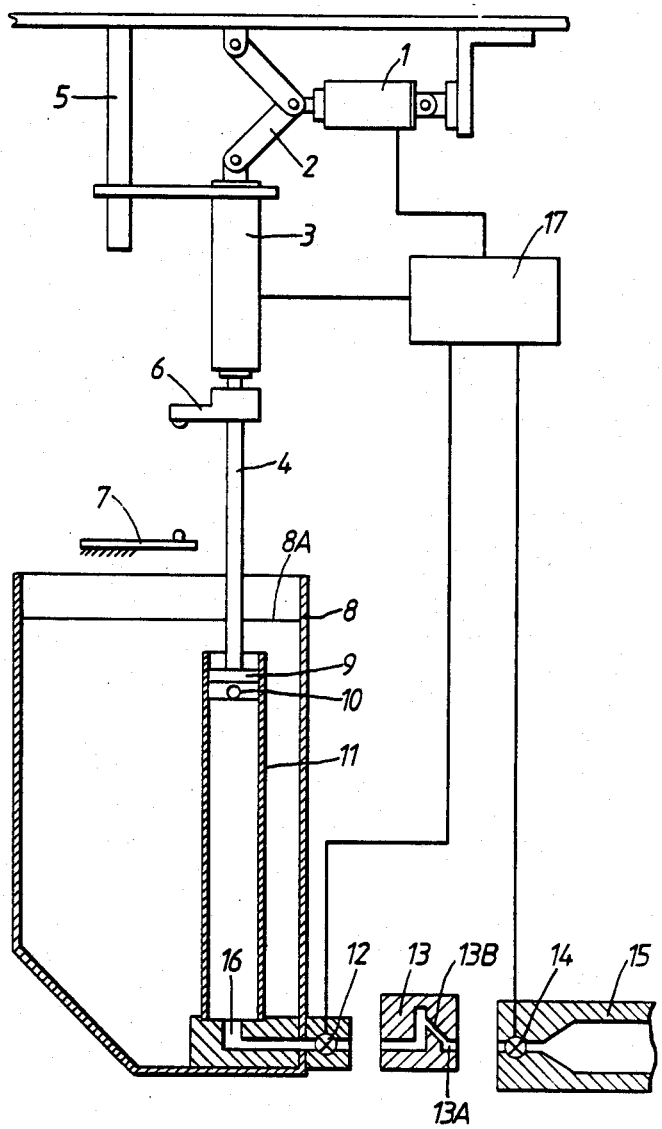
1
2
3
4
5
6
7
8A
8
9
10
11
12
13
13B
13A
14
15
16
17

APPARATUS FOR CASTING METAL ALLOYS HAVING LOW MELTING POINTS

BACKGROUND OF THE INVENTION

The use of a melt-out metal core of complex shape to provide a detailed internal configuration to a subsequently moulded part of plastic material is an area of developing technology, especially in the automobile industry. Such cores are made of a low melting point alloy and are removed from the moulded component by melting.

The prime requirement for these metallic cores is that they should provide accurate dimensional forms, as well as predetermined surface finishes. The metals from which such cores can be made have solidus temperatures in the range of 35° to 300° C.

There are a number of established methods of casting such alloys, ranging from simply pouring the liquid metal into a suitable metallic or non-metallic mould, either by hand or mechanically, through a range of various pressure devices to introduce the metal into the mould cavity, examples of which are centrifugal rubber mould casting, low pressure gravity diecasting, high pressure diecasting, and the Durville casting method.

For the present application it has been found by experience that none of the available techniques provides castings with specific required characteristics of dimensional tolerance, surface finish and lack of internal porosity or cavitation. While diecasting as normally practised produces a good surface finish, there is a tendency to provide porosity in the castings which is unacceptable in the above-mentioned cores.

The object of the invention is to enable low melting point alloys with solidus temperatures in the range 35°–300° C. to be accurately and reproduceably cast.

SUMMARY OF THE INVENTION

The invention accordingly provides a method of producing a casting from a low melting point alloy having a solidus temperature in the range of 35° to 300° C., which comprises subjecting a charge of the molten alloy to pre-pressurisation, then delivering the charge at a flow rate of 0.1 to 1 kg/sec. into a die, and maintaining the metal in the die under pressure for a period longer than that required to fill the die.

The invention also relates to an apparatus for carrying out this method comprising a die, a tank to contain the molten alloy to be cast, a cylinder immersed in the metal in the tank and having at one end an inlet to enable it to fill with the metal, a piston in the cylinder, an outlet valve leading to the die and communicating with an outlet at the other end of the cylinder, and a control system operable to impart, in successive operating cycles, a preliminary stroke to the piston sufficient for it to close the inlet while the outlet valve is closed and then to open the outlet valve and thereafter to impart a further stroke to the piston to deliver molten metal at a flow rate of 0.1 to 1 kg/sec from the cylinder and through the outlet valve into the die, the outlet valve remaining open to maintain the metal within the die under pressure for a period longer than that required to fill the die and then closing to allow the piston to be returned to its initial position in readiness for a further cycle of operations.

DESCRIPTION OF THE FIGURE

The accompanying FIGURE diagrammatically depicts a preferred embodiment of apparatus for producing a metal alloy casting according to the present invention.

DETAILED DESCRIPTION OF THE PREFERRED EMBODIMENT

The apparatus depicted in the FIGURE includes a tank 8 containing liquid metal and a dispensing cylinder 11, having an inlet 10 for liquid at its upper end and an outlet 16 at its lower end which is connected to a lock-off valve 12. The upper end of the cylinder 11 is disposed below the level 8A of liquid in the tank. Operating within the dispensing cylinder 11 is a piston 9 connected to a piston rod 4, carrying a stop bracket 6, which rod is actuated by a pneumatic or hydraulic cylinder 3.

The cylinder 3 is movable by means of a toggle system 2 actuated by a pneumatic or hydraulic cylinder 1 and constrained to move vertically by a guide 5.

The outlet 16 controlled by the valve is connected to a nozzle 13, to the outlet 13A of which, before commencement of a casting cycle, a die 15 is brought into sealing engagement. When the die 15 is to be filled from the side or from below, it is fitted with a valve 14 for retaining liquid metal within it. When provided the valve 14 is opened and closed simultaneously with the valve 12. A microprocessor 17 is provided for effecting sequential operation of the cylinders 1,3 and the valves 12 and 14. Alternatively the cylinders 1, 3 and the valves 12,14 may be actuated by a pneumatic control system including solenoids.

At the start of the casting cycle the valve 12 is closed. The microprocessor 17 first causes the cylinder 1 to close the toggle system 2 and move the piston 9 downwardly to an extent sufficient to cover the liquid metal inlet 10 of the cylinder 11. This serves to effect pre-pressurisation of liquid metal in the cylinder and thus avoids any gravitational surge of metal into the die 15 at a later stage. The valve 12 is then opened and the cylinder 3 is actuated to cause metal to be dispensed into the die 15 by means of the piston 9 until the stop bracket 6 contacts a fixed stop bracket 7.

As the flow rate of metal is critical, it is important that the valve 12 should not open until the piston 9 has closed the inlet 10. This prevents any free fall of metal once the valve 12 is opened. Typical pressures exerted on the column of metal to be delivered are 0.25–3.0 bar.

The volume of liquid metal delivered to the die depends on the position of adjustment of the stop 6 on the rod 4.

After the piston 9 has completed its downward stroke, the valve 12 is held open for a dwell time exceeding the time required for the delivery stroke of the piston 9, so maintaining the metal in the die 15 under pressure until solidification.

The valve 12 then closes and the piston 9 is returned to its initial position in preparation for the next casting cycle.

The die 15 is normally maintained in sealing engagement with the injection mechanism for a time after the valve 12 has closed, to ensure that the still molten inner portion of the casting does not melt its way out. However, it may be required in some cases to cast a hollow core for special conditions of the subsequent plastic moulding. In this case, the seal may immediately be broken to allow part of the molten metal to drain out of the casting.

The stops 6 and 7 need not necessarily be a single mechanical device but may include a proximity switch and/or electro optical technique.

A "swan-neck" 13B in the through passageway of the nozzle 13 ensures that at the end of the stroke of piston 9 and the closing of the valve 12, the liquid metal runs out until the "knife edge" of the "swan-neck" is reached at which point no more metal is released and there is a positive cut off with no dripping.

The apparatus described may constitute an adjunct to a plastic moulding machine, the core metal melted out after the plastic moulding operation being returned to the tank 8, the level in which is maintained high enough to cover the inlet 10.

In one example of use of the apparatus for casting a core of a plastic automobile pump, the composition of the metal in the tank 8 was 56% tin, 3% antimony, the balance lead, the tank was maintained at a temperature of 200°-230° C. and the die 15 at a temperature of 50°-70° C. The weight of each cast core was 0.6 kg. The duration of the second and delivery stroke of the piston 9 was 3 seconds and the dwell time after delivery and before closing of the valve 12 was 7-12 seconds.

In another example of use of the apparatus for casting a core of an automobile injection manifold the metal in the tank 8 was a eutectic alloy of bismuth and tin, the tank was maintained at a temperature of 180° C. and the die at a temperature of 35° C., the weight of each cast core was 20 kg, the duration of the delivery stroke of the piston 9 was 35 seconds and the dwell time was 8 seconds.

It is useful in some cases, e.g. the casting of a core for a plastic automobile intake manifold, to use in the tank 8 a number of injection cylinders 11 and pistons 9 operating as described above to deliver molten metal simultaneously, each to the inlet of a different die.

We claim:

1. An apparatus for producing a casting from a metal alloy having a solidus temperature in the range of 35° to 300° C., said apparatus comprising a die in which the casting can be formed from the metal alloy, a tank which contains the metal alloy in a molten condition, a cylinder located in said tank, said cylinder having a first end and a second end and an inlet opening near its first end which enables molten metal alloy to flow into the cylinder, the second end of said cylinder being arranged to connect with said die and containing an outlet valve to control the flow of molten metal alloy therethrough, a piston which is located in said cylinder and which is reciprocatingly movable between an initial position located between said inlet opening and the first end of said cylinder and positions located between the inlet opening and the second end of said cylinder, drive means for moving said piston along said cylinder, and control means connected to said outlet valve and said drive means, said control means, in successive operating cycles, causing said outlet valve to close and the piston to move from said initial position to a position closer to said second end of said cylinder so as to close the inlet opening and thereby subject the molten metal alloy in the cylinder to a pre-pressurization, then causing said outlet valve to open, then causing said piston to move toward the second end of said cylinder so as to cause molten metal alloy in said cylinder to move through said outlet valve and into said die at a flow rate of 0.1 to 1 kg/sec, then causing said outlet valve to stay in an open state for a time period longer than it takes to fill said die and thus maintain the molten metal alloy in said die under pressure, then causing said outlet valve to close, and then causing said piston to move back to said initial position and thus enable molten metal alloy from said tank to again flow into said cylinder.

2. An apparatus according to claim 1, including a nozzle element located between the second end of said cylinder and said die, said nozzle element including a flow channel extending therethrough, said flow channel including a swan-neck portion which provides a positive cut-off of the flow of molten metal alloy therethrough.

3. An apparatus according to claim 1, wherein said die includes an inlet valve and wherein said control means is connected to said inlet valve to enable said inlet valve to be opened and closed simultaneously with said outlet valve.

4. An apparatus according to claim 1, wherein said drive means comprises first and second power actuators, said first power actuator being directly connected to said piston to move it within said cylinder and said second power actuator being connected to said first power actuator to move said first power actuator towards and away from said cylinder.

5. An apparatus according to claim 4, wherein said second power actuator is connected to said first power actuator by a toggle linkage.

6. An apparatus according to claim 1, wherein the second end of said cylinder is located within said tank and wherein said outlet valve is connected to the second end of said cylinder and extends out of said tank.

* * * * *